US007581946B2

(12) United States Patent
Donnelly et al.

(10) Patent No.: US 7,581,946 B2
(45) Date of Patent: Sep. 1, 2009

(54) IGNITION CONTROL WITH INTEGRAL CARBON MONOXIDE SENSOR

(75) Inventors: Donald E. Donnelly, St. Louis, MO (US); Thomas J. Fredricks, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 528 days.

(21) Appl. No.: 11/265,694

(22) Filed: Nov. 2, 2005

(65) Prior Publication Data

US 2007/0099137 A1 May 3, 2007

(51) Int. Cl.
*F22B 37/42* (2006.01)
*G06F 15/20* (2006.01)

(52) U.S. Cl. ..... 431/76; 431/77; 431/79; 122/14.2; 122/14.21; 73/23.23; 73/1 G; 73/1.03

(58) Field of Classification Search ..... 431/76, 431/77, 79; 122/14.2, 44.8; 73/23.23, 1.07, 73/1 G See application file for complete search history.

(56) References Cited

U.S. PATENT DOCUMENTS 5,347,474 A * 9/1994 Wong ..... 702/86
5,575,274 A 11/1996 DePalma ..... 126/512
5,576,739 A * 11/1996 Murphy ..... 340/3.4
5,659,125 A * 8/1997 Ernst ..... 73/1.03
5,752,818 A 5/1998 Forster ..... 431/76
5,793,296 A 8/1998 Lewkowicz ..... 340/632
5,838,243 A 11/1998 Gallo ..... 340/632
6,213,758 B1 * 4/2001 Tesar et al. ..... 431/12
6,251,344 B1 * 6/2001 Goldstein ..... 422/123
RE37,745 E 6/2002 Brandt et al. ..... 122/14.2
6,484,951 B1 * 11/2002 Mueller ..... 237/2 A
6,722,876 B2 * 4/2004 Abraham et al. ..... 431/22
7,021,925 B2 * 4/2006 Perryman ..... 431/22
7,032,542 B2 * 4/2006 Donnelly et al. ..... 122/14.2
2002/0121126 A1 * 9/2002 Kouznestov et al. ..... 73/1.03
2004/0045543 A1 * 3/2004 Perryman ..... 126/95

* cited by examiner

*Primary Examiner*—Steven B McAllister
*Assistant Examiner*—Nikhil Mashruwala
(74) *Attorney, Agent, or Firm*—Harness, Dickey & Pierce, P.L.C.

(57) ABSTRACT

A control for controlling the operation of a fuel-fired heating appliance is provided that include a sensor capable of sensing the presence of carbon monoxide gas and providing an output indicative of the level of carbon monoxide gas. The control further includes a microprocessor that periodically reads the CO sensor output and stores at least one sensor output value in a memory, wherein the microprocessor responsively discontinues the operation of the appliance when the microprocessor detects a sensor output that has increased by more than a predetermined amount over at least one previously stored sensor output value. In one embodiment, the control is preferably configured to periodically read the sensor output value, and responsive discontinue operation of an appliance upon sensing a predetermined increase of at least a 50 percent increase over the previously monitored sensor output value over a period of about 15 to 90 minutes.

14 Claims, 2 Drawing Sheets

IGNITION CONTROL WITH INTEGRAL CARBON MONOXIDE SENSOR

FIELD OF THE INVENTION

The present invention relates to controls for fuel fired heating appliances, and more specifically to carbon monoxide sensor input to controls for fuel fired water heaters or furnaces.

BACKGROUND OF THE INVENTION

As a result of the increased concern over the dangers of carbon monoxide, many attempts have been made to provide a carbon monoxide detecting device that may be connected to a fuel fired heating appliance to provide for shutting off the appliance in the event harmful levels of carbon monoxide gas should accumulate. However, installing such devices could cause unnecessary shut off of the fuel fired heating appliance, as a result of the carbon monoxide sensor indicating a false level of carbon monoxide. Likewise, improper placement of the sensor could result in a failure to trigger shut down of the appliance even in the presence of harmful levels of carbon monoxide gas concentration. Furthermore, exposure to other chemicals or humidity may affect the output of the sensor, and can lead to difficulties in the interpretation of positive readings of the sensor.

SUMMARY OF THE INVENTION

In accordance with one aspect of the invention, various embodiments of a control for controlling the operation of a fuel-fired heating appliance are provided that include a sensor capable of sensing the presence of carbon monoxide gas and providing an output indicative of the level of carbon monoxide gas. The control further includes a microprocessor that periodically reads the CO sensor output and stores at least one sensor output value in a memory. In some embodiments, the microprocessor responsively discontinues the operation of the appliance when the microprocessor detects a sensor output that has exceeded a store limit value. In one embodiment, the microprocessor responsively discontinues the operation of the appliance when the microprocessor detects a sensor output that has increased by more than a predetermined amount over at least one previously stored sensor output value. In this embodiment, the control is preferably configured to discontinue operation of an appliance upon sensing a predetermined increase of at least a 50 percent over the previously monitored sensor output value. The processor is configured to periodically read the sensor output value, and responsive discontinue heating operation upon reading a sensor value which has increased at least 50 percent over the previously read sensor output value occurring over a period of about 15 to 90 minutes. The control may be configured to discontinue heating operation of the appliance by interrupting the fuel supply to the heating appliance, for example. The control may further activate an alarm signal for communicating the presence of a harmful level of carbon monoxide gas.

In another aspect of the present invention, some embodiments of a control for controlling the operation of a fuel fired heating appliance include a sensor disposed within the control that is capable of sensing the presence of carbon monoxide gas and providing an output indicative of the level of carbon monoxide gas. The control further includes a memory, and a microprocessor in communication with the sensor and the memory. The microprocessor is adapted to periodically read the CO sensor output and store the sensor output in memory, wherein the microprocessor maintains an averaged value of a predetermined number of preceding sensor output values in memory, and the microprocessor responsively shuts off the gas supply to discontinue heating operation of the appliance upon reading a sensor output value that has increased by more than a predetermined amount over the average value stored in memory. Some embodiments may further include a means for providing an alarm output signal, wherein the processor further activates the alarm signal to communicate the presence of a harmful level of carbon monoxide gas nearby the appliance. The control may further include a means for activating a combustion blower, whereupon detecting a predetermined increase in the sensor output and shutting down heating operation, the processor activates the blower to provide for ventilation of the nearby carbon monoxide gas.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
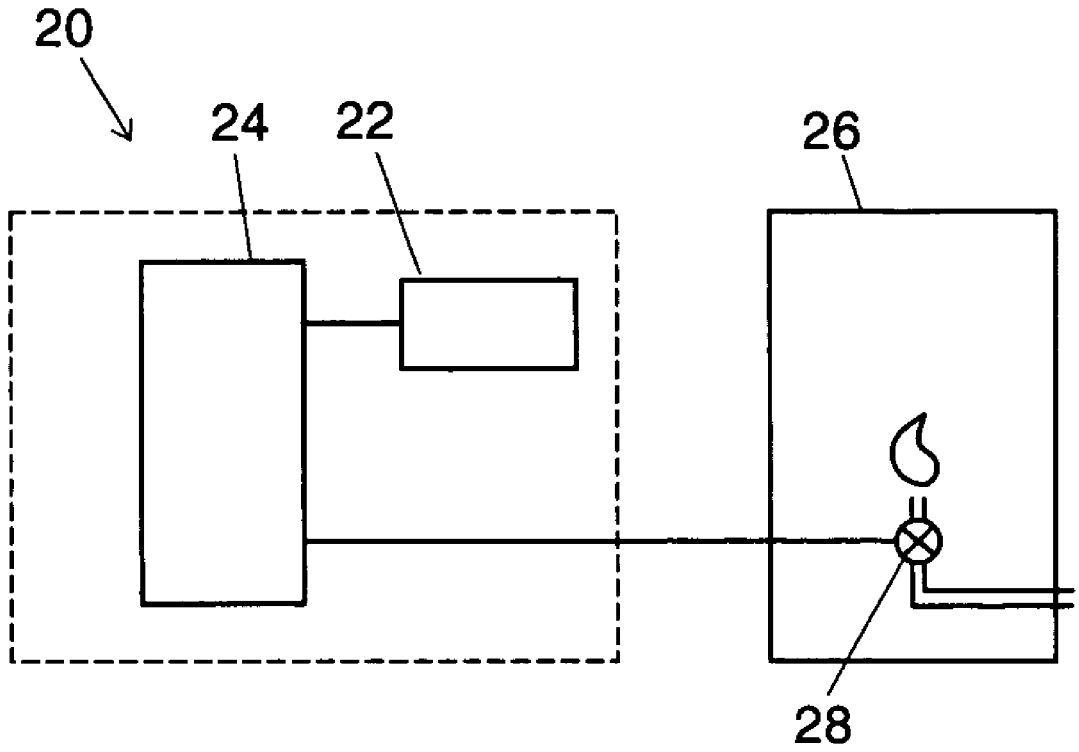
FIG. 1 is a block diagram of one embodiment of a control for a fuel fired heating appliance.

In one embodiment, a control 20 for controlling the operation of a fuel-fired heating appliance is provided that comprises a sensor 22 capable of sensing the presence of carbon monoxide gas and providing an output indicative of the level of carbon monoxide gas, as shown in FIG. 1. The CO sensor output changes in response to sensing an increase in the presence of carbon monoxide gas, and the output preferably increases in response to an increase in the level of carbon monoxide gas concentration. For example, the sensor may be an electrochemical sensor of the Colorimetric type that senses the build-up of CO over time and increases in resistance. The control 20 preferably comprises a processor 24 that monitors the output of the CO sensor 22, and responsively discontinues the operation of the appliance when the sensor's output increases by more than a predetermined amount or exceeds some predetermined upper limit. In one embodiment, the control is preferably configured to discontinue operation of an appliance 26 upon sensing a predetermined increase of at least a 50% over the previously monitored value or averaged number of past sensor readings. The processor is configured to periodically read the sensor output value, and responsive discontinue heating operation upon reading a sensor value which has increased at least 50% over the previously read sensor output value occurring over a period of about 15 to 90 minutes. The control may be configured to discontinue heating operation of the appliance by interrupting the fuel supply 28 to the heating appliance, for example. The control may further activate an alarm signal for communicating the presence of a harmful level of carbon monoxide gas.

One example of a fuel-fired heating appliance that may employ various embodiments of the present invention is a water heater appliance. A water heater appliance may be adapted to include a control with a carbon monoxide (CO) sensor for detecting presence of a harmful level of carbon monoxide gas. The sensor may be an electrochemical sensor that changes in resistance in response to an increase in carbon monoxide presence, and preferably increases in resistance in response to an increase in the level of carbon monoxide gas concentration. Such a sensor could be a Colorimetric Sensor Detector, which measures the build-up of CO over time, and may take up to 48 hours to reset. The CO sensor output increase may be detected by using a signal comparator to monitor the resistance level of the electro-chemical CO sensor. For example, where a typical CO sensor may have a low resistance when sensing less than 100 parts per million of carbon monoxide over a 90 minute period, such resistance could rapidly increase by a factor of 3 to 1 when exposed to a carbon monoxide presence of 300 parts per million (ppm) over a 30 to 90 minute period. If the CO sensor changes to a high resistance as sensed by the signal comparator or input means, the gas supply to the heater may responsively be shut off by the ignition control.

However, it has been observed that CO sensors may undergo changes in resistance due to general ageing, even in a mild environment. Electro-chemical sensors may dry out, or may erode as a result of chemical vapors, e.g., chlorines commonly found in household bleaches. Over time, a CO sensor may gradually increase in resistance sufficient to cause a false shut-down of a furnace system. On the other hand, the resistance of a CO sensor may diminish gradually over time due to other circumstances, possibly to such a low level that it might not trip a shut-down of a heating system if a harmful level of carbon monoxide gas were to occur. Some sensors encounter an output increase with an increase in humidity, and sensor output may fall to zero even in the presence of gas when humidity drops to very low levels. Environmental exposure of the sensor and the effects of humidity on sensor output can lead to difficulties in the interpretation of positive readings of the sensor.

Figure 2:
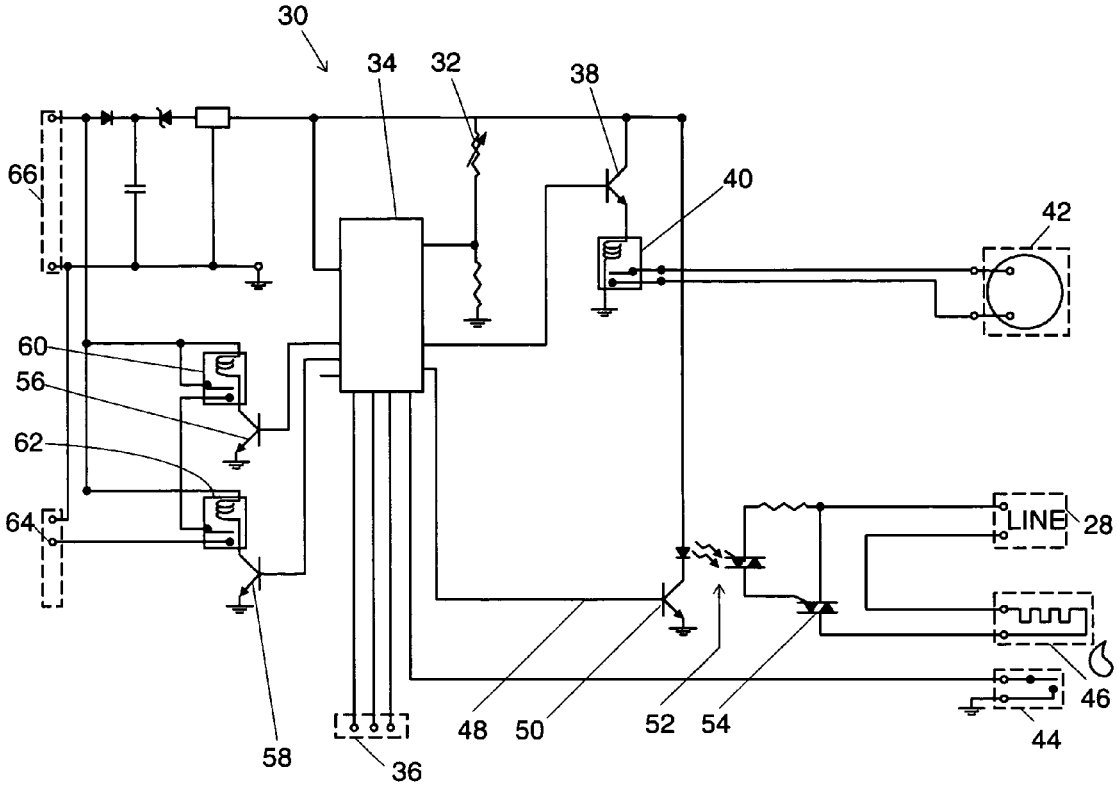
FIG. 2 is a schematic illustrating another embodiment of a fuel fired heating appliance according to the principles of the present invention.

In yet another embodiment of the invention shown in FIG. 2, a control 30 for a fuel fired heating appliance is provided that comprises a carbon monoxide sensor 32 that is integral to the control 30. The Carbon Monoxide sensor 32 integral to the control 30 is preferably a Metal Oxide Semiconductor (MOS) sensor, which may be made of a tin dioxide ($SnO_2$) on a sintered alumina ceramic, for example. The electrical conductivity is low in clean air, but the conductivity increases when exposed to a carbon monoxide presence. The MOS CO sensor therefore has a conductivity output that increases with carbon monoxide level, as opposed to the electrochemical sensor which has a resistance that increases with carbon monoxide level. The MOS sensors offer the ability to detect low (0-100 ppm) concentrations of carbon monoxide gases over a wide temperature range.

The control 30 incorporating the CO sensor 32 comprises a microprocessor 34 for controlling the operation of a heating appliance such as a water heater or a furnace, where the output of the CO sensor 32 is periodically monitored by the microprocessor 34. The microprocessor 34 is communication with a CO sensor 32 of the MOS type, such that the microprocessor is capable of detecting a change in the output of the CO sensor 30 indicative of an increase in the level of carbon monoxide gas nearby the control 30. With the CO sensor being integral to or disposed on the control 20 rather than at a separate location, the mounting of the control 20 relative to the appliance ensures that the sensor 32 is positioned properly to sense the level of carbon monoxide in the vicinity of the appliance. The CO sensor is also protected by the control against exposure to chemicals, humidity or water spills nearby the appliance. The control may further include a screen mesh opening in an enclosure that surrounds the control 20, to permit airflow into the control and faster response to the presence of carbon monoxide around the appliance. In this embodiment, the MOS carbon monoxide sensor is preferably a surface mount device similar in function to type CGS-200 CO sensor manufactured by City Technology, and the microprocessor 34 of the present invention is preferably a PIC16F876A microprocessor manufactured by Microchip.

The microprocessor 34 is further capable of monitoring other signal inputs and responsively controlling the operation of the fuel-fired water heater or furnace. For example, the microprocessor 34 preferably is in communication with a room thermostat 36 for a furnace, or a water temperature sensor 36 for a water heater, that provides an input request for heating operation. When receiving a request signal for heating operation, the microprocessor 34 drives a transistor 38 to activate relay switch 40 to turn on a blower motor 42. When a sufficient level of air flow is established by the blower, a pressure switch 44 will close. The microprocessor 34 detects closure of the pressure switch 44 and responsively switches power to an igniter 46. The microprocessor 34 determines an on-off switching sequence as needed for switching power to the igniter 46 to heat up the igniter to a level sufficient to ignite gas. Specifically, the microprocessor 34 outputs a signal 48 that drives a transistor 50 to switch an opto-traic switch 52 on and off. The opto-triac 52 gates a triac 54 for switching a voltage, such as 120 vac line voltage, to the igniter 46. With the closed pressure switch 44 indicating sufficient air flow and the igniter 46 heated up, the microprocessor 34 drives transistors 56 and 58 for switching a relays 60 and 62 to a closed position to actuate the main valve of the gas valve 64. This initiates the supply of gas to the igniter 46, to establish flame for heating. When the fuel fired heating appliance has satisfied the demand for heating, the microprocessor 34 shuts off the gas valve relays 60 and 62 and the blower relay 40.

In this embodiment, the control 30 comprises a sensor 34 capable of providing an output indicative of the level of carbon monoxide gas. The control further comprises a microprocessor 34 that periodically reads the CO sensor output and stores at least one sensor output value in a memory, wherein the microprocessor 34 responsively discontinues the operation of the appliance when the microprocessor 34 reads a sensor output that has increased by more than a predetermined amount over at least one previously stored sensor output value. The control 34 is preferably configured to discontinue operation upon sensing a predetermined increase of at least a 50% increase over the previously monitored sensor output value. Specifically, the microprocessor 34 is configured to periodically read the output value of sensor 32, and responsively discontinue heating operation upon reading a sensor output value that has increased at least 50% over the previously read sensor output value over a period of about 15 to 90 minutes. Alternatively, the control 30 may responsively discontinue heating operation upon reading a sensed output value that has increased by more than 50 percent over an average of a predetermined number of preceding sensor output values. The microprocessor 34 is preferably configured to read the output value of the sensor 32 at least every 30 minutes. Accordingly, the microprocessor 34 is able to overlook a gradual drift in the output value of the CO sensor that might indicate a false level of carbon monoxide gas, while still being able to detect a sudden increase in the level of carbon monoxide gas concentration, such as a 50 percent increase or more in a 15 to 90 minute time period that may be indicative of a harmful level of 400 parts per million.

Some embodiments of a control for a fuel-fired heating appliance may comprise a microprocessor 34 for controlling the operation of the control 30, and a memory. The microprocessor 34 is adapted to periodically read the output of the CO sensor 34 and store the sensor output value in memory. The microprocessor 34 may perform a calculation using the output value read from the sensor 32, to obtain a running average of the last ten or twenty sensor values. The microprocessor maintains an averaged value of a predetermined number of preceding sensor output values by storing the averaged value in memory. Accordingly, the microprocessor responsively shuts off the gas supply to discontinue heating operation of the appliance upon reading a sensor output value that has increased by more than a predetermined amount over the average value stored in memory. Specifically, the microprocessor 34 is configured to periodically read the output value of sensor 32, and responsively discontinue heating operation upon reading a sensed output value that has increased by more than 50 percent over an average of a predetermined number of preceding sensor output values. The microprocessor 34 is preferably configured to read the output value of the sensor 32 at least every 30 minutes, but may monitor the sensor more frequently as long as the averaged value spans a reasonable time for keeping abreast with the drift of the CO sensor. Accordingly, the microprocessor 34 is able to overlook a gradual drift in the output value of the CO sensor that might indicate a false level of carbon monoxide gas, while still being able to detect a sudden increase in the level of carbon monoxide gas concentration, such as a 50 percent increase or more in a 15 to 90 minute time period that may be indicative of a harmful level of 400 parts per million.

The microprocessor can monitor the operation of the CO sensor, for example, by keeping a running average of the CO sensor resistance. The running average could be updated, for example, each time the control performs a start-up. In another configuration, the running average may be updated every 24 hours. A running average of, for example, the last ten resistance measurements could be used to establish a new CO sensor resistance level. A change, for example, of 50 percent or more in a predetermined time period, such as thirty minutes or less for example, would cause the microprocessor to disconnect the gas supply and/or perform other functions for maintaining a safe condition. Of course, other limits may be placed on the CO sensor. For example, if the running average were to reach a predetermined minimum or maximum value, the microprocessor could trigger a shut-down of the heating appliance. In some embodiments, the microprocessor could also control activation of other equipment for the appliance, such as an exhaust blower for venting carbon monoxide gases near the heating appliance.

Various embodiments of a control for a fuel-fired heating appliance may further comprise a means for providing an alarm output signal, wherein the processor further activates the alarm signal to communicate the presence of a harmful level of carbon monoxide gas nearby the appliance. The control may further comprises a means for activating a combustion blower, whereupon detecting a predetermined increase in the sensor output and shutting down heating operation, the processor activates the blower to provide for ventilation of the nearby carbon monoxide gas.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A control for controlling the operation of a fuel-fired heating appliance, the control comprising:

a CO sensor disposed on the control in the vicinity of the appliance so as to ensure that the CO sensor is capable of sensing the presence of carbon monoxide gas and providing an output that changes relative to changes in carbon monoxide level so as to be indicative of the level of carbon monoxide gas, wherein said CO sensor is subject to changes in output value due to the effects of humidity or general aging;

a memory in which one or more previously sensed sensor output values are stored; and a processor that monitors the CO sensor and stores at least one previously sensed sensor output values in the memory, and responsively discontinues the operation of the appliance when the CO sensor output increases by more than a predetermined amount of at least 50 percent over said at least one previously stored CO sensor output value, such that the control is configured to overlook any drift in the output value within 15 to 90 minute period of the sensor that might indicate an inaccurate level of carbon monoxide gas.

2. The control of claim 1 wherein the predetermined amount of increase is at least a 50% increase over the previously monitored sensor output.

3. The control of claim 1 wherein the processor periodically reads the sensor output at least every 30 minutes.

4. The control of claim 1 wherein the processor further activates an alarm signal for communicating the presence of a harmful level of carbon monoxide gas.

5. A control for controlling the operation of a fuel-fired heating appliance, the control comprising:

a CO sensor integral to and positioned on the control in the vicinity of the appliance so as to ensure that the CO sensor is capable of sensing the presence of carbon monoxide gas and providing an output that changes relative to changes in carbon monoxide level so as to be being capable of sensing the presence of carbon monoxide gas and providing an output that changes relative to changes in carbon monoxide level so as to be indicative of the level of carbon monoxide gas, wherein said CO sensor is subject to changes in output value due to the effects of humidity or general aging;

a memory in which at least one previously sensed CO sensor output value is stored; and a microprocessor that periodically reads the CO sensor output and stores at least one previously sensed sensor output value in the memory, wherein the microprocessor responsively discontinues the operation of the appliance when the microprocessor detects a sensor output that has increased by more than a predetermined amount of at least 50 percent over at least one previously stored sensor output value, over a period of 15 to 90 minutes, such that the control is configured to overlook any drift in the output value of the sensor that might indicate an inaccurate level of carbon monoxide gas.

6. The control of claim 5 wherein the predetermined amount of increase is at least a 50% increase over the previously monitored sensor output.

7. The control of claim 5 wherein the processor periodically reads the sensor output at least every 30 minutes.

8. The control of claim 5 wherein the processor further activates an alarm signal for communicating the presence of a harmful level of carbon monoxide gas.

9. The control of claim 5 further comprising means for activating a combustion blower, whereupon detecting a predetermined increase in the sensor output and shutting down heating operation, the processor activates the blower to provide for ventilation of the nearby carbon monoxide gas.

10. A control for controlling the operation of a fuel-fired heating appliance, the control comprising:

a CO sensor disposed within the control that is positioned in the vicinity of the appliance so as to ensure that the CO sensor is capable of sensing the presence of carbon monoxide gas and providing an output that changes relative to changes in carbon monoxide level so as to be indicative of the level of carbon monoxide gas, wherein said CO sensor is subject to changes in output value due to the effects of humidity or general aging;

a memory in which one or more previously sensed sensor output values are stored; and a microprocessor in communication with the sensor and the memory, the microprocessor being adapted to periodically read the CO sensor output and store one or more previously sensed values of the sensor output in the memory, wherein the microprocessor maintains an averaged value of a predetermined number of at least ten preceding CO sensor output values in memory, and the microprocessor responsively shuts off the gas supply to discontinue heating operation of the appliance upon reading a CO sensor output value that has increased by more than a predetermined amount of at least 50 percent over the average value stored in memory, over a period of 15 to 90 minutes, such that the control is configured to overlook any drift in the output value of the sensor that might indicate an inaccurate level of carbon monoxide gas.

11. The control of claim 10 wherein the predetermined number of sensor values that are averaged is in the range of about 10 to 20 sensor output readings.

12. The control of claim 10 wherein the processor periodically reads the sensor output at least every 30 minutes.

13. The control of claim 10 wherein the processor further activates an alarm signal for communicating the presence of a harmful level of carbon monoxide gas.

14. The control of claim 10 further comprising means for activating a combustion blower, whereupon detecting a predetermined increase in the sensor output and shutting down heating operation, the processor activates the blower to provide for ventilation of the nearby carbon monoxide gas.

* * * * *

UNITED STATES PATENT AND TRADEMARK OFFICE

CERTIFICATE OF CORRECTION

PATENT NO. : 7,581,946 B2
APPLICATION NO. : 11/265694
DATED : September 1, 2009
INVENTOR(S) : Donnelly et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 716 days.

Signed and Sealed this

Fourteenth Day of September, 2010

David J. Kappos

David J. Kappos
*Director of the United States Patent and Trademark Office*